US006522090B2

(12) United States Patent
Heishi et al.

(10) Patent No.: US 6,522,090 B2
(45) Date of Patent: Feb. 18, 2003

(54) CATHODE RAY TUBE DISPLAY DEVICE AND CATHODE RAY TUBE DISPLAY METHOD

(75) Inventors: Akinori Heishi, Tokyo (JP); Hironobu Yasui, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,504

(22) Filed: Oct. 24, 2001

(65) Prior Publication Data

US 2002/0047659 A1 Apr. 25, 2002

(30) Foreign Application Priority Data

Oct. 25, 2000 (JP) ..... 2000-326040
Apr. 23, 2001 (JP) ..... 2001-124392

(51) Int. Cl.[7] ..... H01J 29/51
(52) U.S. Cl. ..... 315/370; 313/421; 313/427
(58) Field of Search ..... 315/366, 368.11, 315/368.16, 368.24, 370, 387, 399; 313/421, 426–428, 368, 387

(56) References Cited

U.S. PATENT DOCUMENTS 4,456,853 A * 6/1984 Robinder et al. ..... 313/421
5,032,769 A * 7/1991 Kawakami ..... 315/368
6,208,092 B1 * 3/2001 Kim ..... 315/370

FOREIGN PATENT DOCUMENTS

JP 11224618 8/1999
WO 00/63945 10/2000

* cited by examiner

*Primary Examiner*—Don Wong
*Assistant Examiner*—Wilson Lee
(74) *Attorney, Agent, or Firm*—Birch, Stewart, Kolasch & Birch, LLP

(57) ABSTRACT

When an interval between a Gm electrode and a cathode is broadened with temperature, a potential change similar to a case that a Gm electrode voltage is lowered is generated. If a cathode voltage is constant, a quantity of electrons which pass is decreased whereupon a screen of a cathode ray tube becomes dark. A Gm electrode voltage control circuit is provided to a Gm electrode voltage source for control an applied voltage to the Gm electrode by time information from a time-measuring circuit such that the change of the interval between the cathode and the Gm electrode is corrected during a period of time between the time the voltage is applied to each electrode of a Hi-Gm tube and the time the change of a size of the interval between the cathode and the Gm electrode is saturated.

8 Claims, 10 Drawing Sheets

TURN POWER SUPPLY ON
POINT WHERE TEMPERATURE RISE IS SATURATED
TEMPERATURE OF ELECTRON GUN 20
TIME
t

INTERVAL BETWEEN CATHODE 7 AND Gm ELECTRODE 4
TIME

OUTPUT OF TIME-MEASURING CIRCUIT 11
v1
TIME

OUTPUT OF Gm ELECTRODE VOLTAGE SOURCE 10
v3
v2
TIME

OUTPUT OF TIME-MEASURING CIRCUIT 11
TIME

CATHODE RAY TUBE DISPLAY DEVICE AND CATHODE RAY TUBE DISPLAY METHOD

BACKGROUND OF THE INVENTION

1. Field of the Invention

The present invention relates to a cathode ray tube display device using a cathode ray tube including an electron gun having a Gm electrode for modulation and a cathode ray tube display method.

2. Description of the Related Art

FIG. 7 is an explanatory enlarged cross-sectional view of a neighborhood of a cathode of an electron gun in a cathode ray tube (hereinafter referred to as Hi-Gm tube) described in Japanese Patent Laid-Open No. 224618/1999. In FIG. 7, reference numerals 7, 6, 5, 3 and 16 denote a cathode, a G1 electrode for drawing an electron from the cathode 7, a G2 electrode for drawing the electron from the cathode 7, a G3 electrode for drawing the electron from the cathode 7 and an electron emissive material provided on a surface of the cathode 7, respectively. Further, reference numeral 4 denotes a Gm electrode for modulation which is disposed between the G2 electrode and the G3 electrode and is capable of modulate an electron current of electrons emitted from the cathode 7. Furthermore, in an ordinary electron gun, provided are electrodes subsequent to the G3 electrode, namely, for example, a G4 electrode, a G5 electrode and a bead glass supporting a constitution as a whole, namely, for example, the electrodes.

An exemplary constitution of the above-described electron gun is that a thickness of the G1 electrode 6: t1=0.08 mm, a thickness of the G2 electrode 5: t2=0.1 mm, a thickness of the G3 electrode: t3=0.5 mm, a thickness of the G3 electrode 3: t3=0.5 mm, a thickness of the Gm electrode 4: tm=0.1 mm and a material for each of these electrodes is stainless steel (SUS303, SUS304 and the like). Further, intervals between adjacent two electrodes (in an above-described order) are L1 0.8 mm, L2=0.13 mm, L3=0.10 mm and L4=0.9 mm, respectively. Furthermore, a diameter of an aperture of each of the G1 electrode 6, the G2 electrode 5 and the Gm electrode 4 is about 0.35 mm and that of the G3 electrode 3 is about 1.3 mm.

By taking the above-described constitution, while it has been necessary to change a voltage of the cathode 7 as much as about 40 V for changing an emission current which is the electron current by 0 $\mu$A to 300 $\mu$A for a black-and-white display on a screen, it becomes possible to control the emission current by changing that of the Gm electrode 4 by 10 V and to display by a low voltage.

FIG. 8 is a graph showing a potential distribution in the neighborhood of the cathode 7 of the electron gun 20 in the Hi-Gm tube. In the graph, an abscissa axis and an ordinate axis designate a distance (mm) from the cathode 7 and a potential (V), respectively; a curve 17 shows a potential around a rotational axis of symmetry in the neighborhood of the cathode 7. An arrow mark indicated by reference numeral 18 denotes a region in which the Gm electrode 4 exists (also referred to as existence region)and which is disposed in a distance of about 0.5 mm from the cathode 7. To take an example, the G1 electrode 6, the G2 electrode 5, the G3 electrode 3, the Gm electrode, the anode of the Hi-Gm tube are applied by voltages of 0 V, 500 V, 5.5 KV, 80 V and 25 KV, respectively.

The potential of the Gm electrode 4 is set at 80 V and a dashed line in FIG. 8 shows 80 V. A position (also referred to a minimal position) 19 at which a potential is minimal must exist in the region (also referred to as existence region) 18 in which the Gm electrode 4 exists. When the potential of the cathode 7 is lower than the potential of this position 19, the electron passes through the position 19 and then proceeds in a direction of the screen; however, when higher, the electron can not pass through the position 19 so that it does not proceed in the direction of the screen. When the minimal position 19 exists farther than the existence region 18 seen from the cathode 7, an influence of a potential which the Gm electrode 4 generates becomes smaller, that is, a potential change similar to a case that the voltage of the Gm electrode is lowered is generated from the standpoint of the cathode 7. On the other hand, when the minimal position 19 exists nearer to the cathode 7 than the existence region 18, the influence of the potential of the Gm electrode to the electron current becomes larger, that is, the potential change similar to a case that the voltage of the Gm electrode is elevated is generated from the standpoint of the cathode 7.

In the case of the above-described Hi-Gm tube, since a Gm electrode of an electron gun is disposed in a position much closer to a cathode of the electron, say, about 0.5 mm from the cathode in a direction of a screen, than the cathode ray tube using a conventional electron gun so that, when a temperature of the electron gun is increased one by being heated by a heater and another by allowing a bead current to flow into the cathode, a bead glass which supports the cathode 7 and the Gm electrode 4 is subjected to a heat deformation as well as the cathode 7 and the Gm electrode 4 both of which are made of metal are also subjected to a head deformation whereupon an interval between the cathode 7 and the Gm electrode 4 is changed in a minute degree. The thus generated change of the above-described interval continues until the temperature rise of the electron gun 20 is saturated. Owing to such change, a potential in the neighborhood of the Gm electrode 4 changes whereupon the level thereof at which an electron can pass changes.

Therefore, when the interval between the Gm electrode and the cathode is broadened with the temperature of the electron gun 20, a potential change similar to a case that a Gm electrode voltage is lowered is generated so that, when a cathode voltage is constant, a quantity of electrons which pass is decreased. That is, a quantity of electrons which passes through between an anode 2 and the cathode 7 is decreased whereupon a screen of the cathode ray tube becomes dark.

SUMMARY OF THE INVENTION

The present invention has been achieved to solve the above-described problems and has an object to provide a cathode ray tube display device and cathode ray tube display method which is capable of stabilizing an emission current which is an electron current thereby producing a stable luminance of the screen even during a period of time from the time when a power supply of the cathode ray tube display device is turned on till the time when a temperature rise of the electron gun 20 is saturated.

A cathode ray tube display device according to the present invention comprises a time-measuring unit for measuring an elapsed time which is a period of time since a voltage was applied to a cathode ray tube, and a Gm electrode voltage control unit for controlling an applied voltage to the above-described Gm electrode such that a change of an interval between the above-described cathode and the Gm electrode is corrected by the above-described elapsed time.

Further, a cathode ray tube display method according to the present invention comprises the steps of:

measuring time by starting measuring an elapsed time which is a period of time from a time of voltage application to a cathode ray tube;

controlling a Gm electrode voltage for changing an applied voltage to the above-described Gm electrode until the above-described elapsed time reaches a preset time at which a temperature rise of the above-described electron gun is saturated; and fixing the Gm electrode voltage for stopping changing the applied voltage to the above-described Gm electrode after the above-described elapsed time has gone over the preset time.

DETAILED DESCRIPTION OF THE PREFERRED EMBODIMENTS

The present invention is now described in detail with reference to the preferred embodiments shown in the accompanying drawings.

First Embodiment

Figure 1:
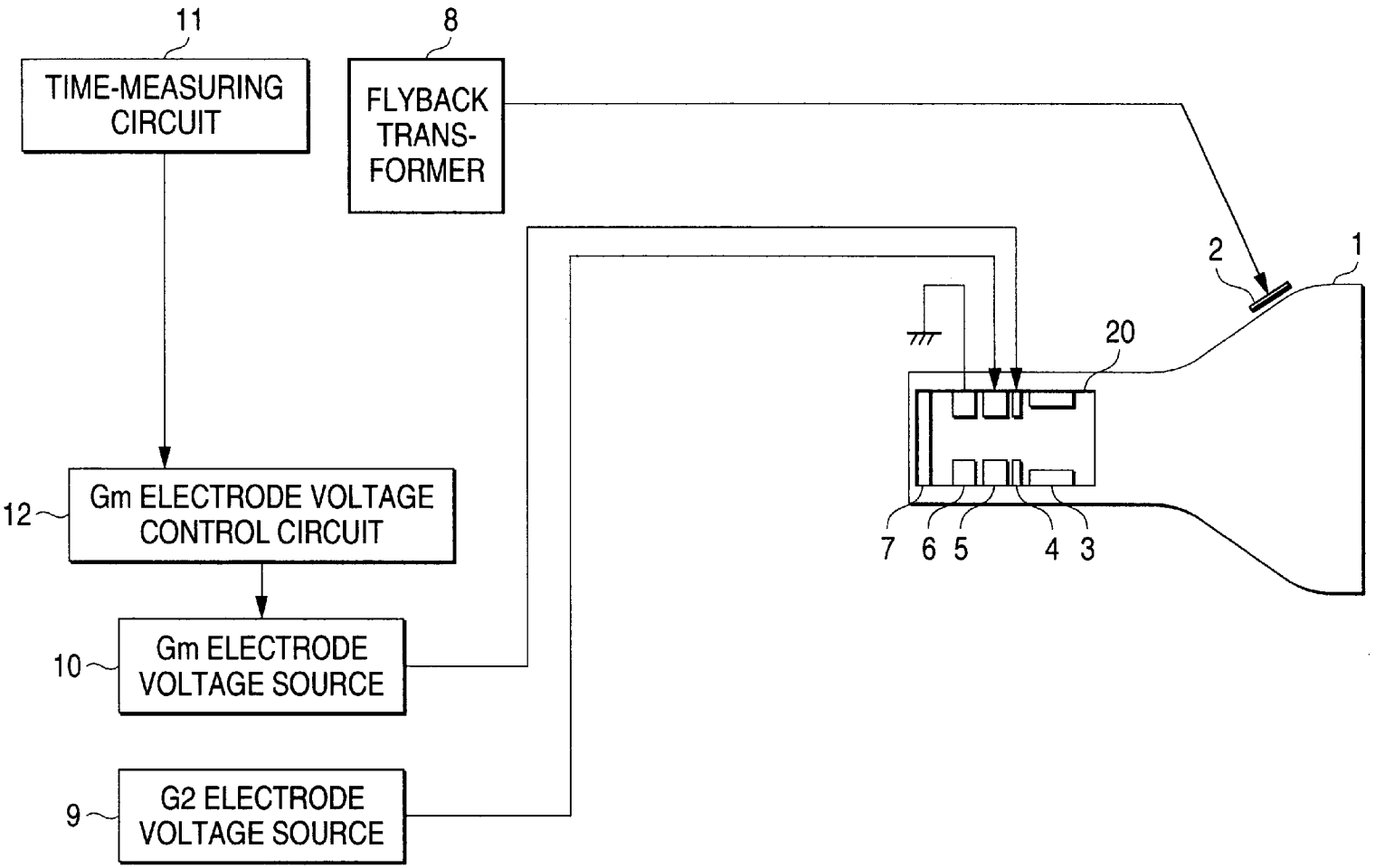
FIG. 1 is a constitution of a cathode ray tube display device according to first embodiment of the present invention.

FIG. 1 is a constitution of a cathode ray tube display device according to first embodiment of the present invention.

In FIG. 1, reference numerals 7, 6, 5, 3, 20, 2 and 1 denote a cathode, a G1 electrode which is earthed and draws an electron from the cathode 7, a G2 for drawing the electron from the cathode 7, a G3 electrode for drawing the electron from the cathode 7, an electron gun for CRT at least comprising: the cathode 7; and the G1 electrode 6, the G2 electrode 5 and the G3 electrode 3 in this order from the cathode 7 and, further, comprising: a Gm electrode 4 which is a modulation electrode between the G2 electrode 5 and the G3 electrode 3, an anode and a Hi-Gm tube which is a cathode ray tube comprising the electron gun 20, respectively. Further, 8, 9, 10, 11 and 12 denote a flyback transformer for applying a voltage of about 25 KV to the anode 2, a G2 electrode voltage source to apply a voltage to the G2 electrode 5, a Gm electrode voltage source for applying a voltage to the Gm electrode 4, a time-measuring circuit for measuring an elapsed time which is a period of time since a voltage was applied to the Hi-Gm tube by turning on a power supply of the cathode ray tube display device, and a Gm electrode voltage control circuit for controling an applied voltage to the Gm electrode against the Gm electrode voltage source such that a change of the interval between the above-described cathode 7 and the Gm electrode 4 is corrected during a period of time required from the time when a voltage is applied to each electrode of the Hi-Gm tube till the time when a temperature rise is saturated whereby a change of a size between the cathode 7 and the Gm electrode 4 is saturated, being based on the elapsed time from the time-measuring circuit 11.

On this occasion, the temperature rise of the electron gun 20 has a correlation with a heater voltage and an elapsed time from a voltage application time at which a beam current starts flowing; also, there is a correlation between the temperature rise of the electron gun 20 and a size of an interval between the Gm electrode 4 and the cathode 7. Further, an amount of electrons which pass through the interval between the anode 2 and the cathode 7 has a correlation with the size of the interval between the Gm electrode 4 and the cathode 7, and the voltage of the Gm electrode 4. On account of these correlations, it is necessary for the Gm electrode voltage control circuit 12 to control the applied voltage to the Gm electrode 4 such that a change of the beam current is cancelled against the change of the size of the interval between the Gm electrode 4 and the cathode 7 caused by the temperature rise of the electron gun 20.

In FIG. 1, since the constitution is same as that of an ordinary cathode ray tube display device except for the electrodes of G1 to G3 and Gm of the electron gun 20, it is omitted. The Gm electrode 4 is provided in a position at a distance of 0.5 mm or thereabouts from a surface of the cathode 7; a potential in this position is determined by setting a DC potential of the Gm electrode at about 80 V; when the above-described potential becomes higher than that of the cathode 7, the electron passes whereas, when lower, the electron does not pass.

Figure 2:
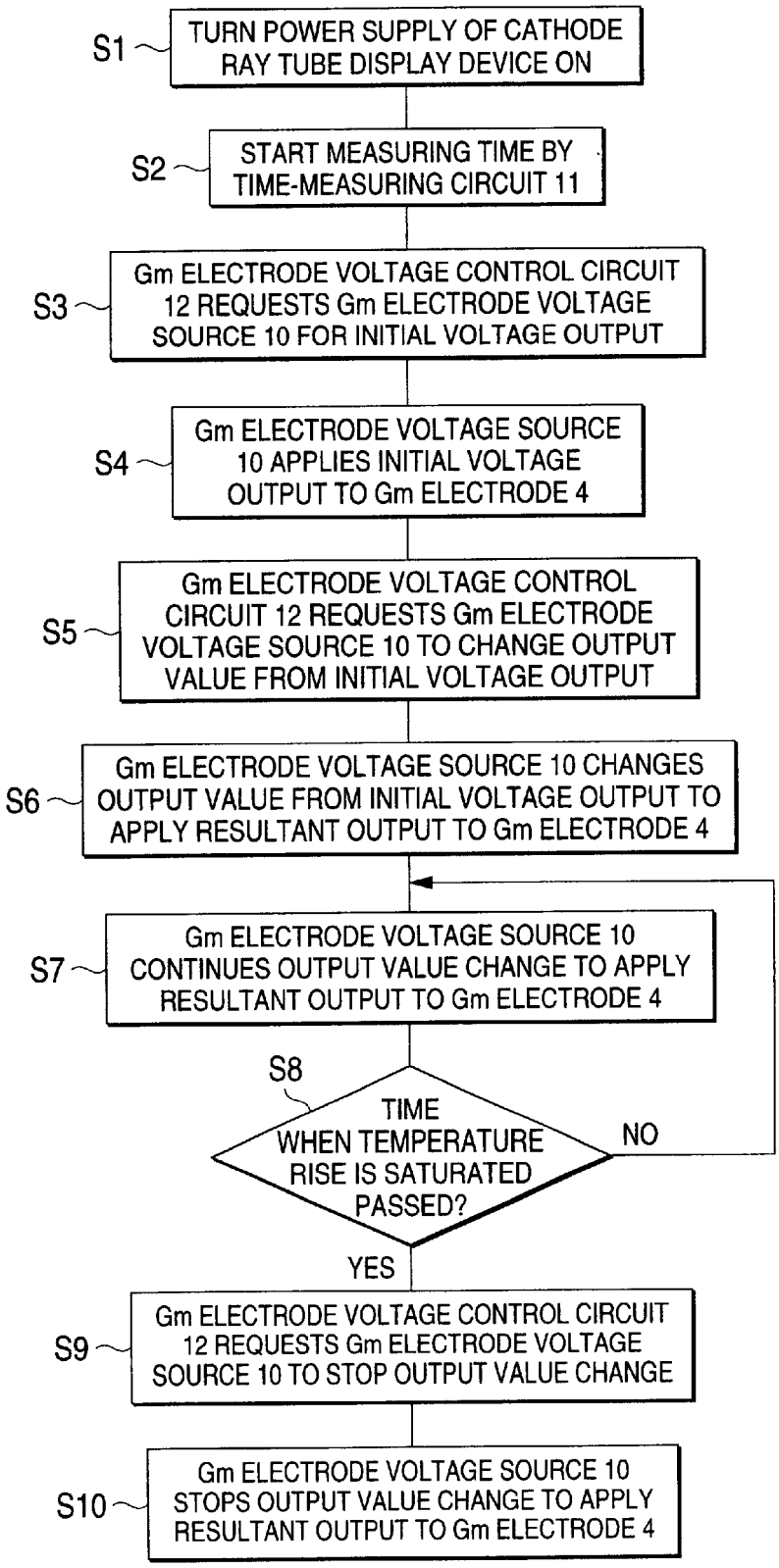
FIG. 2 is a flowchart showing a cathode ray tube display method according to first embodiment of the present invention.

FIG. 2 is a flowchart representing operative steps in the present embodiment. In FIG. 2, S1 is a step which turns on a power supply of the cathode ray tube display device to apply an voltage to each of the electrodes of the Hi-Gm tube 1; S2 is a step in which time-measuring is started by the time-measuring circuit 11 and an elapsed time is outputted to the Gm electrode voltage control circuit 12 by means of a pulse output of a fixed frequency, a charging voltage output, a digital data output in parallel or other optional data output; S3 is a step in which the Gm electrode voltage control circuit 12 requests the Gm electrode voltage source 10 for an initial voltage output; S4 is a step in which the Gm electrode voltage source 10 applies the initial voltage output to the Gm electrode 4; S5 is a step in which the Gm electrode voltage control circuit 12 requests the Gm electrode voltage source 10 to change an output value from the initial voltage output; S6 is a step in which the Gm electrode voltage source 10 changes the output value from the initial voltage output and applies a resultant output to the Gm electrode 4; S7 is a step in which the Gm electrode voltage source 10 continues an output value change and applies a resultant output to the Gm electrode 4; S8 is a step which judges whether a predetermined time when the temperature rise is saturated has passed or not and, when the predetermined time has not passed, goes back to Step 7; S9 is a step in which the Gm electrode voltage control circuit 12 requests the Gm electrode voltage source 10 to stop the output value change; S10 is a step in which the Gm electrode voltage source 10 stops the output value change and applies a resultant output to the Gm electrode 4.

More specifically, a case in which, after the power supply of the cathode ray tube display device is turned on, each of the electrodes of the Hi-Gm tube is applied with the voltage and then the interval between the Gm electrode 4 and the cathode 7 is broadened with the temperature rise of the electron gun 20 is considered. FIGS. 9A to 9E illustrates operations of the circuit relative to time passage.

Figures 9A, 9B, 9C, 9D, 9E:
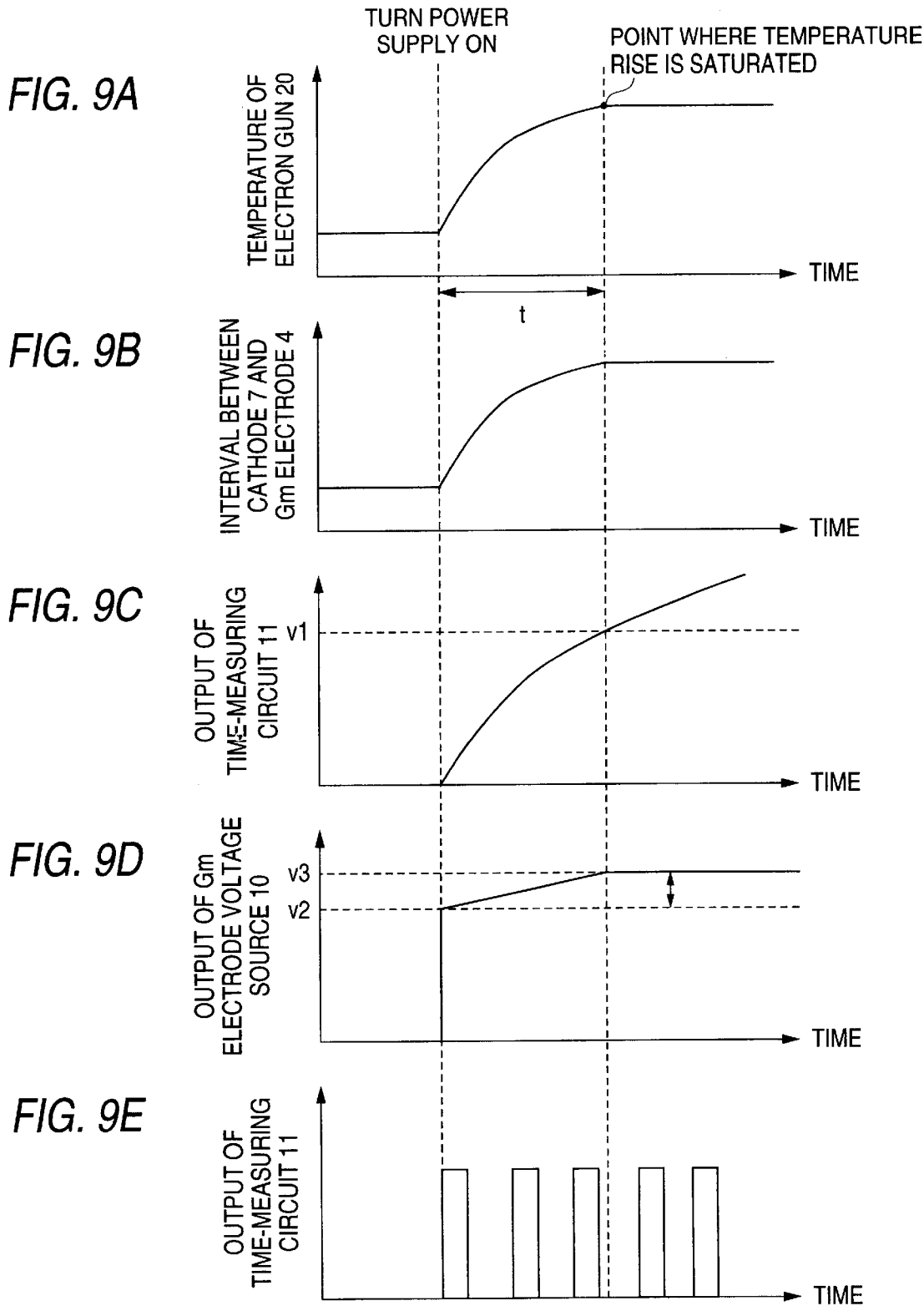
FIG. 9A is a graph showing a time change of a temperature of an electron gun according to first embodiment of the present invention.
FIG. 9B is a graph showing a time change of an interval between a cathode and a Gm electrode according to first embodiment of the present invention.
FIG. 9C is graph showing an output voltage relative to time of a time-measuring circuit according to the first embodiment of the present invention.
FIG. 9D is a graph showing a time change of an output voltage of a Gm electrode voltage source according to first embodiment of the present invention.
FIG. 9E is a graph showing an output voltage relative to time of a time-measuring circuit according to first embodiment of the present invention.

A character t in FIG. 9A represents the time when the temperature rise of the electron gun 20 (or the cathode 7) is saturated and also the time when the change of the interval between the cathode 7 and the Gm electrode 4 of the electron gun 20 in FIG. 9B is saturated. In the present embodiment, the above-described time t is a preset time having a constant value. In a case in which the time-measuring circuit 11 outputs the charging voltage as shown in FIG. 9C, it is measured whether or not the elapsed time has reached the preset time t taking v1 for the charging voltage output value at the time when the preset time t has passed.

The Gm electrode voltage control circuit 12 controls the output from the Gm electrode voltage source 10 as shown in FIG. 9D, during a period of time from the time the power supply is turned on till v1 is inputted from the time-measuring circuit 11. This type of control is executed for the purpose of allowing the beam current to have a value corresponding to the cathode voltage. The output of the Gm electrode voltage source 10 is v2 when the power supply is turned on; v2 becomes v3 by the time v1 is inputted to the Gm electrode voltage control circuit 12 after the preset time t has passed; thereafter, v3 is maintained as it stands. Accordingly, against the same cathode potential, the beam current in a case in which v2 is applied to the Gm electrode before the temperature rise of the electron gun 20 and the beam current in a case in which v3 is applied to the Gm electrode after the temperature rise of the electron gun 20 become same with each other. A controlling method is, as in an ordinary control of the output of the power supply, to perform a control at a feedback point of a power supply circuit or to control a reference voltage of the power supply.

Further, in the present embodiment, being based on an assumption that the size of the interval between the Gm electrode 4 and the cathode 7 is enlarged, which is a same situation as that the Gm electrode voltage is reduced, there exists a relation of v3>v2 in FIG. 9D. On this occasion, a change from V2 to v3 may not be linear.

When the output of the time-measuring circuit 11 is the pulse output of a constant frequency as shown in FIG. 9E, the Gm electrode voltage control circuit 12 counts a number of rise or fall of pulses which are the output from the time-measuring circuit 11 and then controls the Gm electrode voltage source 10 during a period of time until a pulse number reaches the preset time t such that the voltage shown in FIG. 9D is outputted and, when the pulse number becomes greater than the preset time t, maintains the output value of the Gm electrode voltage source 10 as it stands.

On the other hand, when the interval between the Gm electrode 4 and the cathode 7 is narrowed, the Gm electrode voltage control circuit 12 controls the Gm electrode voltage source 10 during a period of time until the elapsed time reaches the preset time t such that the Gm electrode voltage control circuit 12 lowers the Gm electrode voltage and, when the elapsed time goes over the preset time t, maintains the output value of the Gm electrode voltage source 10 as it stands.

In the present embodiment, even when the interval between the Gm electrode 4 and the cathode 7 is changed with the temperature rise of the electron gun 20 started from the time each of the electrodes of the Hi-Gm tube 1 is applied with the voltage by turning the power supply of the cathode ray tube display device on, a change of a quantity of electrons which pass can be suppressed by controlling the Gm electrode voltage source 10 even if the cathode voltage is constant.

Second Embodiment

Figure 3:
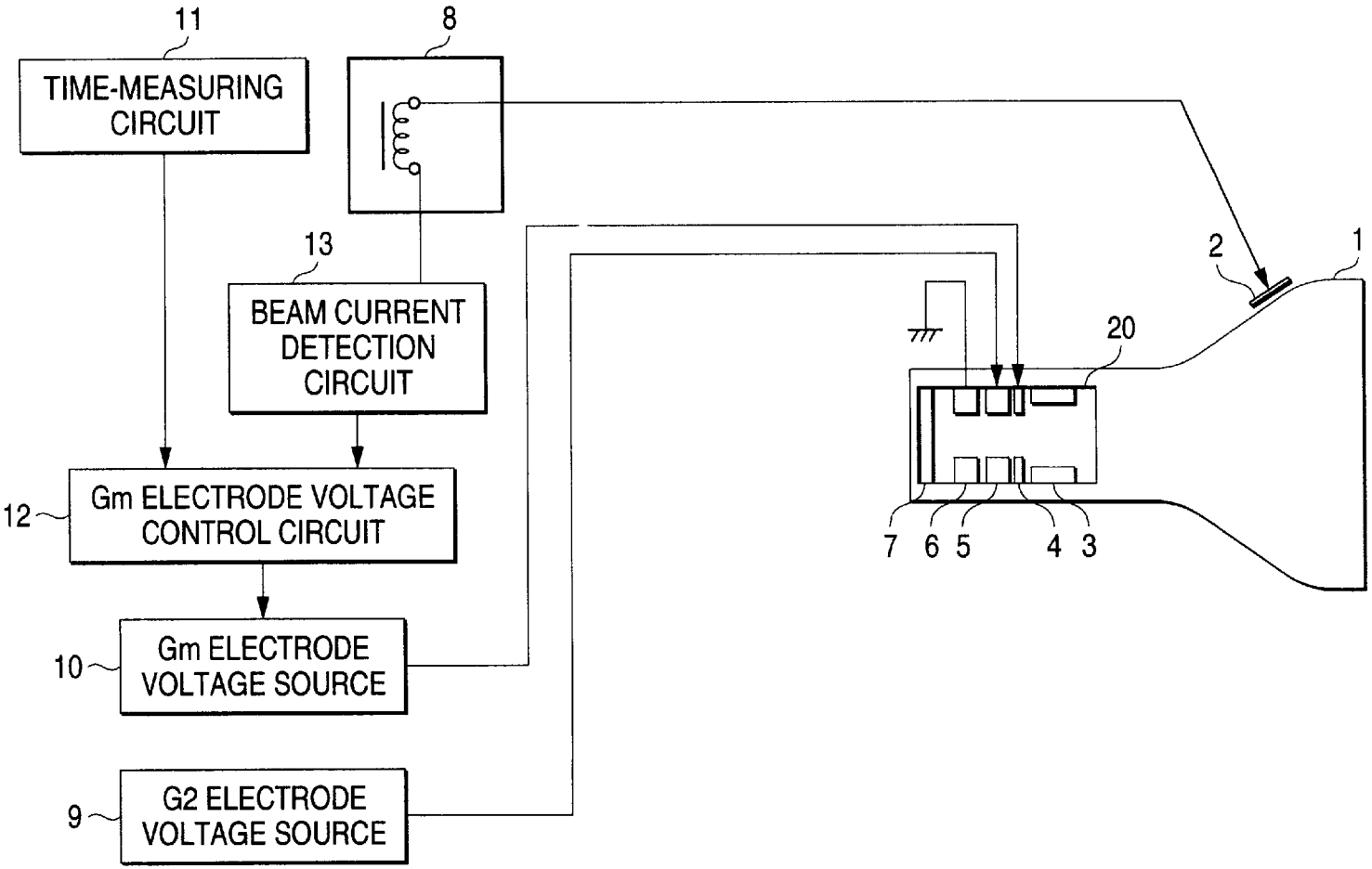
FIG. 3 is a constitution of a cathode ray tube display device according to second embodiment of the present invention.

The first embodiment is constituted such that the preset time t which is time data showing that the change of the interval between the cathode 7 and the Gm electrode 4 is saturated is set in the Gm electrode voltage control circuit 12 and, then, the applied voltage to the Gm electrode 4 is controlled in a manner that the change of the beam current to be caused by the change of the interval between the cathode 7 and the Gm electrode 4 is cancelled depending on whether or not the output of the elapsed time measured by the time-measuring circuit 11 has reached the preset time t. However, in a second embodiment, as shown in FIG. 3, an average beam current which flows from the anode 2 to the cathode 7 is detected and, then, the Gm electrode voltage source 10 is controlled such that the Gm electrode voltage is regulated.

For a detection of the beam current, a resistor which is connected with a winding of the flyback transformer 8 in series is provided in a beam current detection circuit 13 and is constituted such that the beam current flows in the resistor whereupon the beam current can be detected from a difference of potentials of both ends of the resistor.

The brighter a video displayed on the screen of the Hi-Gm tube is, the more the above-described average beam current flows and vice versa, i.e., the darker the video, the less the current. Therefore, the time the temperature rise of the electron gun 20 is saturated changes in accordance with the video. That is, when a bright video is inputted and the average current flows much, the temperature rise is saturated in a short period of time whereupon the change of the interval between the cathode 7 and the Gm electrode 4 is saturated in a short period of time.

Figure 10:
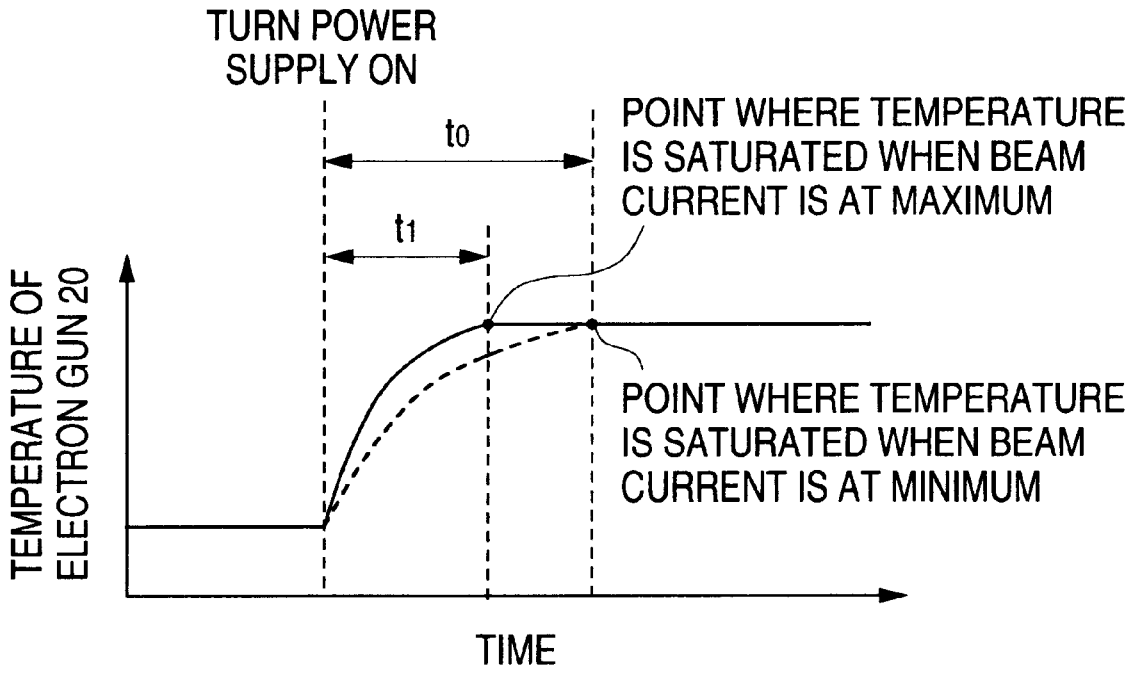
FIG. 10 is a graph showing a time change of a temperature of an electron gun according to second embodiment of the present invention.

FIG. 10 is a graph showing temperature rises of the electron gun 20 when the beam current is at the minimum and at the maximum, in the graph, an abscissa axis and an ordinate axis designate a time and a temperature of the electron gun 20, respectively; wherein t0 represents a temperature rise saturation time at the time the beam current is at the minimum; t1 represents the temperature rise saturation time at the time the beam current is at the maximum. A relation between t0 and t1 is t0>t1. The temperature rise saturation time ts in accordance with a quantity of the beam current is $t1 \leqq ts \leqq t0$. A correlation between the quantity of the beam current and the temperature rise saturation time ts is stored in the Gm electrode voltage control circuit 12 and then a optimal temperature rise saturation time is determined by a time-measuring output from the time-measuring circuit 11 and the output from the beam current detection circuit 13. To take an example, the Gm electrode voltage control circuit 12 is constituted by a microcomputer and a memory and, in the latter, a relation between the beam current amount and the temperature rise saturation time ts is set as map data in advance.

In FIG. 3, reference numeral 13 denotes a beam current detection circuit disposed in an opposite end of the wiring of the flyback transformer 8 from the anode 2. For example, resistors are connected in series and the beam current value is detected from voltage between both ends of the thus-connected resistors. Further, the Gm electrode voltage control circuit 12 controls the Gm electrode voltage source 10 by information from the beam current detection circuit 13 that the beam current is subjected to voltage conversion to produce voltage such that the more the beam current is after the voltage is applied to each electrode of the Hi-Gm tube 1 by turning the power supply of the cathode ray tube display device on, the shorter the temperature rise saturation time ts becomes and the more an increasing rate of the Gm electrode voltage is allowed. After the temperature rise saturation time ts has passed, the Gm electrode voltage maintains v3.

By executing a control as described above, the Gm electrode voltage control circuit 12 suppress the potential change which is similar to a case that the Gm electrode voltage is lowered whereupon a quantity of electrons which pass the Gm electrode 4 is corrected.

Figure 4:
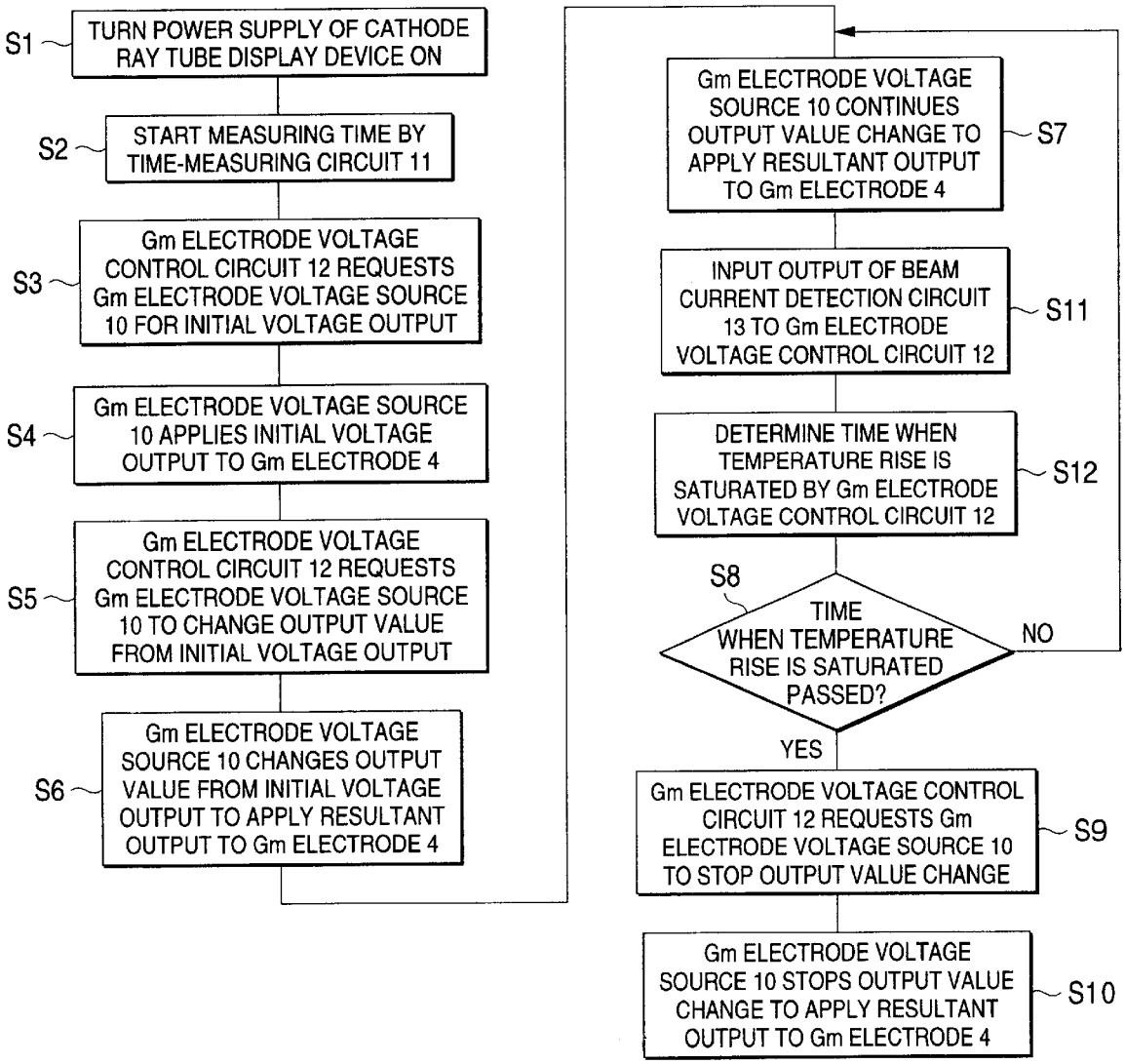
FIG. 4 is a flowchart showing a cathode ray tube display method according to second embodiment of the present invention.

FIG. 4 is a flowchart showing a cathode ray tube display method according to the present embodiment. S11 is a step in which an output of the beam current detection circuit 13 is inputted to the Gm electrode voltage control circuit 12 subsequent to step S7. S12 is a step which determines the time when the temperature rise is saturated by the Gm electrode voltage control circuit 12 and send the thus determined result to S8. All steps except for S11 and S12 are the same as those in the first embodiment. On the other hand, when the interval between the Gm electrode 4 and the cathode 7 becomes narrower, the Gm electrode voltage control circuit 12 may control the Gm electrode voltage source 10 such that the Gm electrode voltage is lowered.

The time needed for saturating the temperature rise in step 8 is from several minutes to several hours and the time required for steps 1 to 8 is as short as 100 ms or less using a microcomputer. Therefore, it is permissible that a Gm electrode voltage change in steps 5 to 7 is same as the voltage change in steps 5 to 7 in the first embodiment.

In the present embodiment, a relation between the beam current and the temperature rise of the electron gun 20 is measured in advance and stored in a memory element of the Gm electrode voltage control circuit 12. Thereafter, by turning on the cathode ray tube display device, an optimal temperature rise saturation time ts of the electron gun 20 for each beam current in accordance with different video on the screen can be determined. The Gm electrode voltage control circuit 12 controls the Gm electrode voltage up until the elapsed time reaches the temperature rise saturation time ts and maintains the Gm electrode voltage as it stands after the temperature rise saturation time ts has passed. As a result, a quantity of electrons which pass the Gm electrode 4 can be optimally corrected.

Third Embodiment

Figure 5:
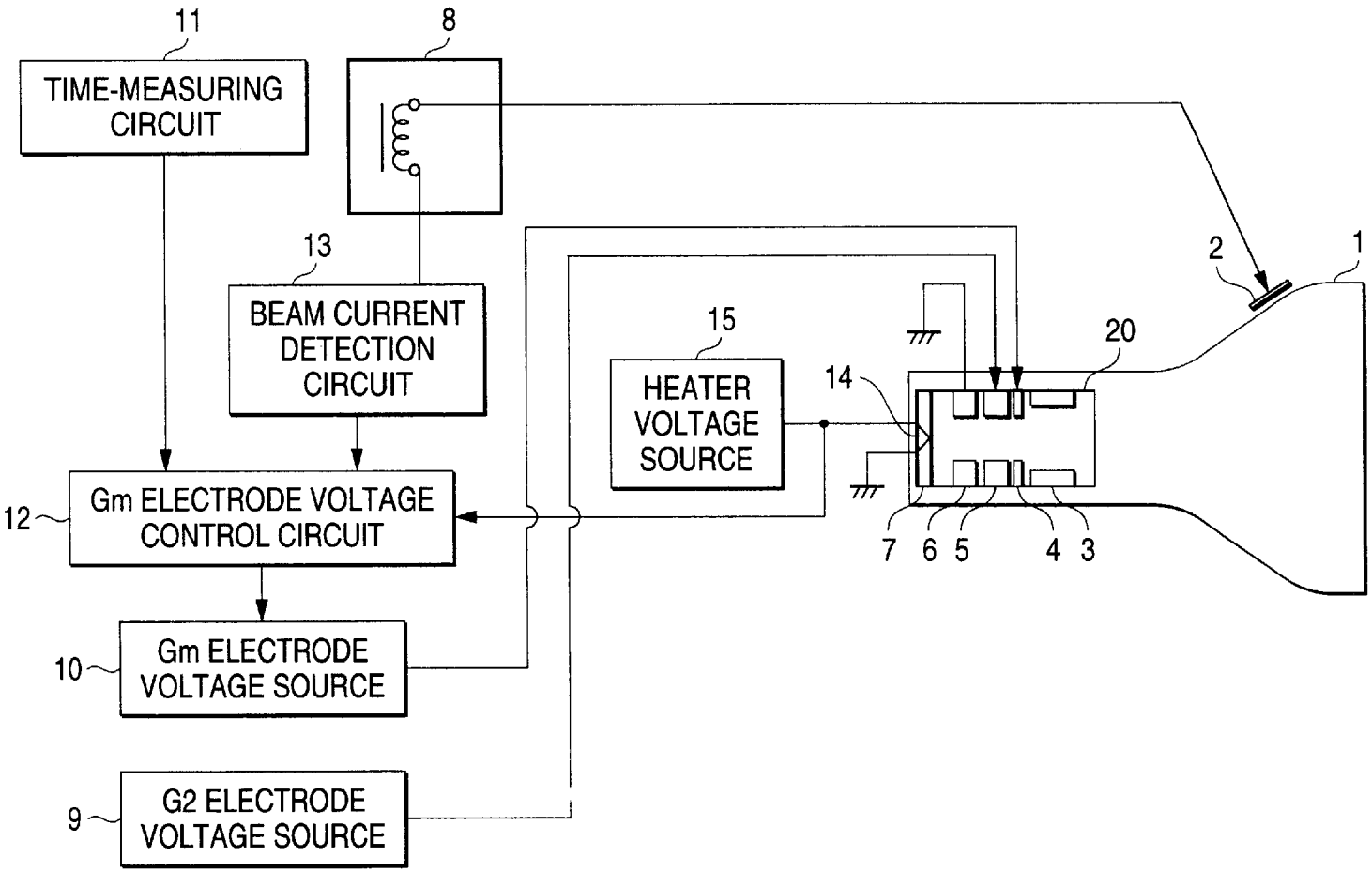
FIG. 5 is a constitution of a cathode ray tube display device according to third embodiment of the present invention.

FIG. 5 is a block diagram showing a constitution of a cathode ray tube display device according to the third embodiment. In FIG. 5, reference numerals 14 and 15 denote a heater for heating the cathode 7 and a heater voltage source which applies a voltage to the heater 14 and outputs voltage application information to the Gm electrode voltage control circuit 12, respectively. The Gm electrode voltage control circuit 12 detects presence or absence of provision of a heater voltage and controls the Gm electrode voltage source 10 such that the Gm electrode voltage is controlled, after the heater voltage is provided.

Figure 11A:
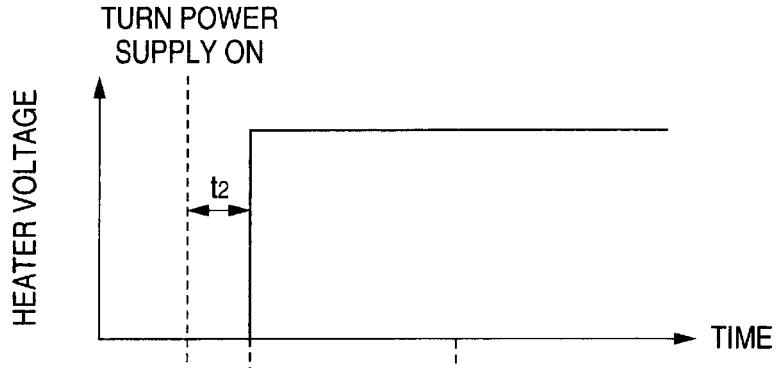
FIG. 11A is a graph showing a time change of a heater voltage.
Figure 11B:
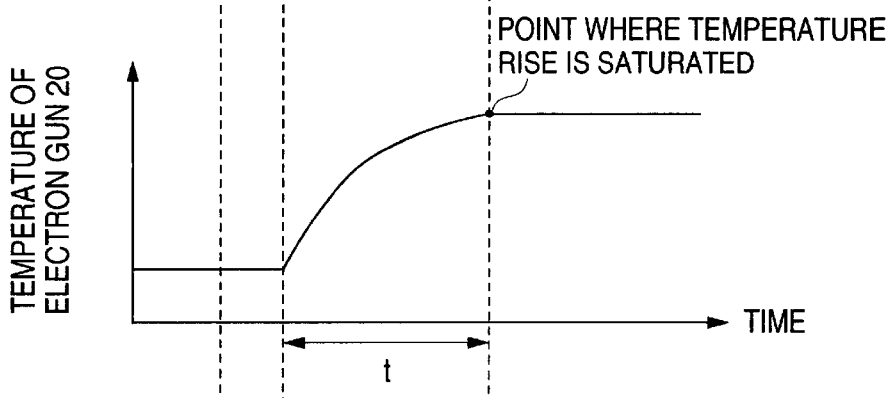
FIG. 11B is a graph showing a time change of a temperature of an electron gun according to third embodiment of the present invention.
Figure 11C:
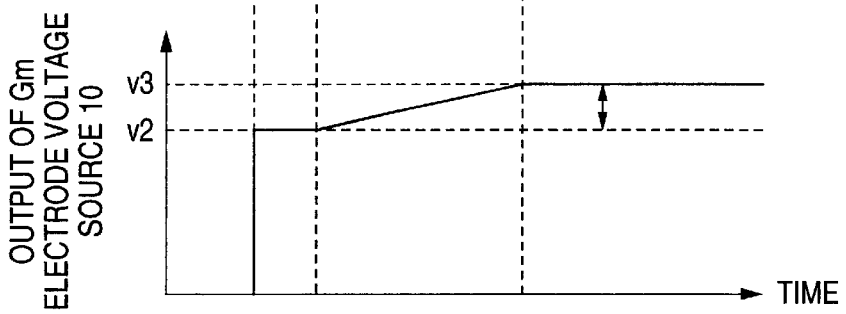
FIG. 11C is a graph showing a time change of an output voltage of a Gm electrode voltage source according to third embodiment of the present invention.

That is, when the heater voltage is supplied in a time relation as shown in FIG. 11A, a temperature of the electron gun 20 rises from a point of time when the heater voltage is provided after the time t2 between turning the power supply on and provision of the heater voltage has passed (see FIG. 11B) so that the Gm electrode voltage control circuit 12 controls such that the output of the Gm electrode voltage source 10 comes to be as shown in FIG. 11C after the time t2 subsequent to turning the power supply on has passed. (The output of the Gm electrode voltage source 10 is v2 when the power supply is turned on, maintains v2 during the time of t2 before the heater voltage is provided, becomes v3 after the time of t2 has passed and, thereafter, maintains v3.) Further, in FIG. 11C, the voltage is controlled in a linear manner; however, when the value of v2 is same as that of v3, a change of the voltage may be executed in another manner.

Figure 6:
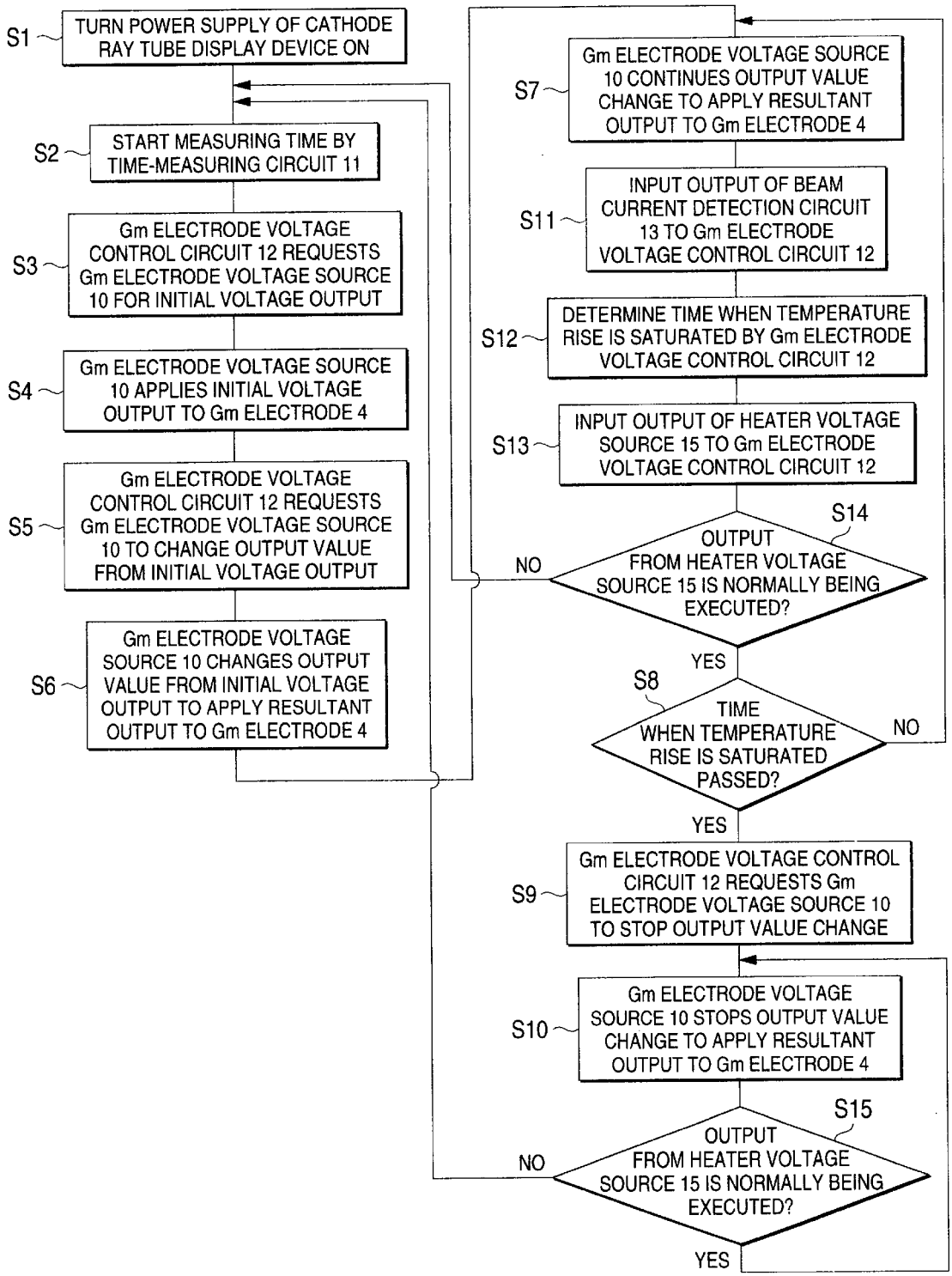
FIG. 6 is a flowchart showing a cathode ray tube display method according to third embodiment of the present invention.
Figure 7:
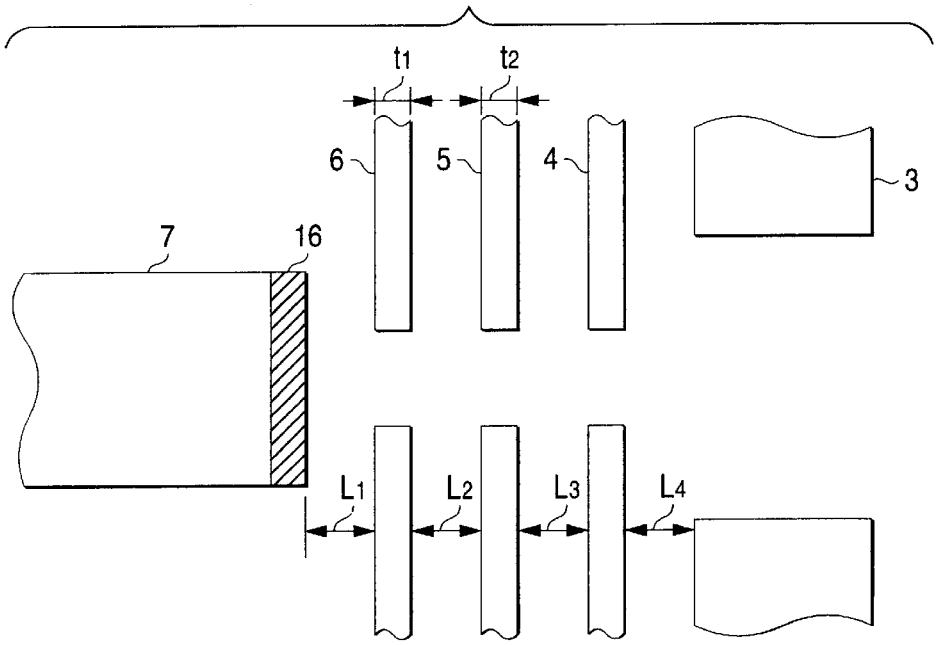
FIG. 7 is a cross-sectional view of a constitution of a conventional electron gun.
Figure 8:
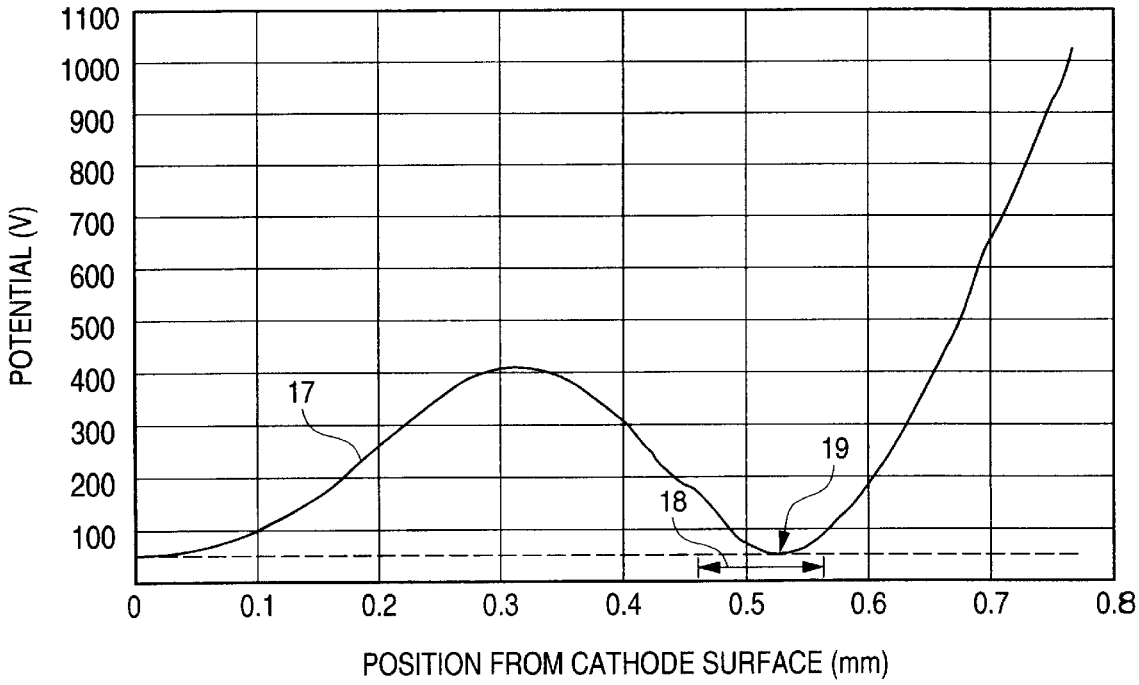
FIG. 8 is a graph showing a potential of a conventional electron gun.

FIG. 6 is a flowchart showing a cathode ray display device according to the present embodiment. In FIG. 6, S13 is a step which inputs the output of the heater voltage source 15 to the Gm electrode voltage control circuit 12 after step 11. S14 is a step which judges whether or not the output of the heater voltage source 15 is normally being executed and, when the output is normally being executed, proceeds to step S8 while, when not, proceeds to step S2. After steps moves along from step S8 to S9 and, then, to step S15 via step S10, S15 judges whether or not the heater voltage source 15 is normally outputted at S15 and, when the output is normally being executed, the step proceeds to step S10 whereas, when not, the step proceeds to step S2. Further, all steps except for steps S13, S14 and S15 are same as those in the second embodiment.

In the present embodiment, when the cathode ray tube display device is in a standby mode or the like whereupon the voltage provision from the heater voltage source 15 is stopped, an operation of the Gm electrode voltage control circuit 12 is reset and the Gm electrode voltage source 10 is controlled such that the Gm electrode voltage control circuit 12 increases the Gm electrode voltage again, when the provision of the heater voltage is next provided and, then, after the temperature rise saturation of the electron gun 20, the Gm electrode voltage is maintained as it stands. By executing a control as described above, the potential change similar to a case that the Gm electrode voltage is lowered is suppressed whereupon a quantity of electrons which pass the Gm electrode 4 is corrected.

Since the present embodiments are constituted as described above, they perform effects as describe below.

An image which keeps a stable luminance from the time of applying a voltage to a cathode ray tube can be obtained by comprising a time-measuring unit for measuring an elapsed time which is a period of time since the application time at which the voltage was applied to the cathode ray tube and a Gm electrode voltage control unit for controlling an applied voltage to the above-described Gm electrode such that an interval between the above-described cathode and the above-described Gm electrode is corrected by the above-described elapsed time.

Further, the Gm electrode voltage control unit controls the applied voltage to the above-described Gm electrode until the above-described elapsed time reaches the preset time at which the temperature rise of the above-described electron gun is saturated, and maintains the applied voltage to the above-described Gm electrode as it stands whereby the beam current can be stabilized from the point of time of application of the voltage to the cathode ray tube after the above-described elapsed time has gone over the above-described preset time.

Further, an image which keeps a stable lightness in view of a difference of a period of time till a temperature rise of the cathode ray tube is saturated by a video can be obtained by comprising a beam current detection unit for detecting an average beam current which flows between an anode of the cathode ray tube and the cathode and allowing the Gm electrode voltage control unit to control the applied voltage to the above-described Gm electrode by the average beam current from the above-described beam current detection unit.

Further, being based on a relation between the above-described average beam current which has previously been set and a period of time until the temperature rise of the above-described electron gun is saturated, the Gm electrode voltage control unit determines the saturation time which is a period of time until the temperature rise of the above-described electron gun is saturated, controls the applied voltage to the above-described Gm electrode up until the above-described elapsed time reaches the above-described saturation time, and maintains the applied voltage to the above-described Gm electrode as it stands whereupon the beam current can be stabilized in accordance with a content of an image after the above-described elapsed time has gone over the above-described saturation time.

Further, an image which keeps a stable luminance can be obtained in view of a difference of an operative mode of the cathode ray tube display device by allowing the Gm electrode voltage control unit to control the applied voltage to the above-described Gm electrode when there exists an output from a heater voltage application unit for applying a voltage to a heater which heats the above-described cathode.

Furthermore, in the cathode ray tube display method according to the present invention, an image which keeps a stable luminance can be obtained in view of the saturation time of the temperature rise (also referred to as temperature rise saturation time) of the cathode ray tube by comprising a time-measuring step for starting measuring the elapsed time which is a period of time since a voltage was applied to the cathode ray tube, a Gm electrode voltage controlling step for changing an applied voltage to the above-described Gm electrode until the above-described elapsed time reaches the preset time at which the temperature rise of the above-described electron gun is saturated and a Gm electrode voltage fixing step for stopping changing the applied voltage to the above-described Gm electrode after the above-described elapsed time has gone over the preset time.

Further, being based on a relation between an average beam current which has previously been set by a beam current which detects the above-described average beam current flowing between the anode of the cathode ray tube and the above-described cathode and a period of time until the temperature rise of the above-described electron gun is saturated, an image which keeps a stable luminance can be obtained in view of a difference of time when the temperature rise of the cathode ray tube is saturated in accordance with a difference of video by comprising a temperature rise saturation time determining step for outputting the time when the temperature rise of the above-described cathode ray tube is saturated and allowing the above-described Gm electrode voltage fixing step to determine the time when the temperature rise of the above-described cathode ray tube is saturated by the output from the above-described temperature rise saturation time determining step.

Further, an image which keeps a stable luminance can be obtained, in view of a difference of an operative mode of the cathode ray tube display device, by comprising a heater voltage output step for starting time-measuring again in the above-described time-measuring step in a case in which the applied voltage to the heater of the above-described cathode does not exist in at least one of a pre-stage and post-stage of the above-described Gm electrode voltage fixing step.

What is claimed is:

1. A cathode ray tube display device, comprising:

a cathode ray tube including an electron gun for CRT having: a cathode; at least a G1 electrode, a G2 electrode and a G3 electrode which draw an electron from said cathode in this order from a side of said cathode; and, further, having: a Gm electrode which is a modulation electrode between the G2 electrode and the G3 electrode;

a time-measuring unit for measuring an elapsed time that is a period of time since an application time at which a voltage was applied to said cathode ray tube; and a Gm electrode voltage control unit for controlling an applied voltage to said Gm electrode such that a change of an interval between said cathode and said Gm electrode is corrected by said elapsed time.

2. The cathode ray tube display device as set forth in claim 1, wherein said Gm electrode voltage control unit controls the applied voltage to said Gm electrode until said elapsed time reaches a preset time at which a temperature rise of said electron gun is saturated and maintains the applied voltage to said Gm electrode as it stands after said elapsed time has gone over said preset time.

3. The cathode ray tube display device as set forth in claim 1, further comprising:

a beam current detection unit for detecting an average beam current which flows between an anode of said cathode ray tube and said cathode, wherein said Gm electrode voltage control unit controls the applied voltage to said Gm electrode by the average beam current from said beam current detection unit.

4. The cathode ray tube display device as set forth in claim 3, wherein said Gm electrode voltage control unit determines a saturation time at which the temperature rise of said electron gun is saturated, being based on a relation between said average beams current which has previously been set and a period of time until the temperature rise of said electron gun is saturated, controls the applied voltage to said Gm electrode until said elapsed time reaches said saturation time and maintains the applied voltage to said Gm electrode as it stands after said elapsed time has gone over said saturation time.

5. The cathode ray tube display device as set forth in claim 1, wherein, in a case in which there is an output from a heater voltage application unit that applies a voltage to a heater which heats said cathode, said Gm electrode voltage control unit controls the applied voltage to said Gm electrode.

6. A cathode ray tube display method comprising the steps of:

measuring time by starting measuring an elapsed time which is a period of time since a voltage was applied to a cathode ray tube including an electron gun for CRT having: a cathode; at least a G1 electrode, a G2 electrode and a G3 electrode which draw an electron from said cathode in this order from a side of said cathode; and, further, having: a Gm electrode which is a modulation electrode between the G2 electrode and the G3 electrode;

controlling a Gm electrode voltage for changing an applied voltage to said Gm electrode until said elapsed time reaches a preset time at which a temperature rise of said electron gun is saturated; and fixing the Gm electrode voltage for stopping changing the applied voltage to said Gm electrode after said elapsed time has gone over said preset time.

7. The cathode ray tube display method as set forth in claim 6, further comprising the step of determining a temperature rise saturation time for outputting a time at which a temperature rise of said cathode ray tube is saturated, being based on a relation between said average beam current which has previously been set by a beam current which detects an average beam current which flows between an anode of said cathode ray tube and said cathode and a period of time until the temperature rise of said electron gun is saturated, wherein said step of fixing Gm electrode voltage determines the time at which the temperature rise of said cathode ray tube is saturated by the output from said step of determining the temperature rise saturation time.

8. The cathode ray tube display method as set forth in claim 6, further comprising the step of outputting a heater voltage for starting time-measuring again in said step of measuring time, in a case in which an applied voltage to the heater of said cathode does not exist in at least one of a pre-stage and post-stage of said step of fixing the Gm electrode voltage.

* * * * *